US010625968B2

(12) United States Patent
Huang et al.

(10) Patent No.: US 10,625,968 B2
(45) Date of Patent: Apr. 21, 2020

(54) MEDIA DIVERSION APPARATUS

(71) Applicant: Hewlett-Packard Development Company, L.P., Houston, TX (US)

(72) Inventors: Xiaoxi Huang, Singapore (SG); Bo Pu, Singapore (SG); Ah Chong Tee, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/097,868

(22) PCT Filed: Jun. 29, 2016

(86) PCT No.: PCT/US2016/004008

§ 371 (c)(1),
(2) Date: Oct. 31, 2018

(87) PCT Pub. No.: WO2018/004561

PCT Pub. Date: Jan. 4, 2018

(65) Prior Publication Data

US 2019/0135568 A1 May 9, 2019

(51) Int. Cl.

| | |
|---|---|
| ***B65H 29/58*** | (2006.01) |
| ***B65H 5/26*** | (2006.01) |
| ***B41J 11/48*** | (2006.01) |

(52) U.S. Cl.

CPC ..... *B65H 29/58* (2013.01); *B41J 11/48* (2013.01); *B65H 5/26* (2013.01); *B65H 2301/12* (2013.01); *B65H 2404/632* (2013.01); *B65H 2701/11312* (2013.01); *B65H 2801/36* (2013.01)

(58) Field of Classification Search

CPC ..... B65H 29/58; B65H 29/60; B65H 2701/11312; B65H 2801/36; B65H 2404/632; B65H 5/26; B41J 11/48

See application file for complete search history.

(56) References Cited

U.S. PATENT DOCUMENTS 4,721,298 A * 1/1988 Pitcher, Jr. ..... B65H 29/58 271/303

5,012,295 A 4/1991 Ikkatai et al.

(Continued)

FOREIGN PATENT DOCUMENTS

CN 1127703 A 7/1996
CN 102020140 A 4/2011

(Continued)

OTHER PUBLICATIONS

Unknown, "Epson® SureColor® P800 User's Guide", EPSON Exceed Your Vision, 2008, 209 pages, < https://files.support.epson.com/docid/cpd4/cpd43251.pdf >.

*Primary Examiner* — Patrick Cicchino

(74) *Attorney, Agent, or Firm* — HP Inc. Patent Department

(57) ABSTRACT

A media diversion apparatus for a printing system is described. In an example implementation, the apparatus comprises a media diverter to route media printed by a print assembly of a printing system. The media diverter, in a first position, is to route cut-sheet media from the print assembly to a first output region. The media diverter, in a second position, is to route roll media from the print assembly to a second output region.

10 Claims, 8 Drawing Sheets

(56) References Cited

U.S. PATENT DOCUMENTS

| | | | | |
|---|---|---|---|---|
| 6,776,408 | B2 * | 8/2004 | Suzuki | B65H 29/60 271/188 |
| 7,831,191 | B2 * | 11/2010 | Mandel | B41J 3/62 271/9.01 |
| 8,056,899 | B2 * | 11/2011 | Byun | B65H 29/58 271/303 |
| 8,276,913 | B2 | 10/2012 | Bianco et al. | |
| 8,714,541 | B2 | 5/2014 | Kato | |
| 8,807,564 | B2 * | 8/2014 | Reidhaar | B65H 85/00 271/186 |
| 8,936,243 | B1 | 1/2015 | Muir et al. | |
| 9,738,479 | B2 * | 8/2017 | Iwasawa | G03G 15/234 |
| 10,065,827 | B2 * | 9/2018 | Takaba | B65H 29/125 |
| 2003/0189280 | A1 | 10/2003 | Stevens | |
| 2007/0170639 | A1 * | 7/2007 | Istre | B65H 3/0623 271/121 |
| 2007/0257426 | A1 | 11/2007 | DeGruchy | |
| 2017/0173980 | A1 * | 6/2017 | Gonzalez Perello | B41J 15/16 |

FOREIGN PATENT DOCUMENTS

| | | | |
|---|---|---|---|
| CN | 102241205 | A | 11/2011 |
| CN | 203254788 | U | 10/2013 |
| CN | 103707663 | A | 4/2014 |
| CN | 104444548 | A | 3/2015 |
| JP | 3061130 | B2 | 7/2000 |
| JP | 2001247244 | | 9/2001 |
| JP | 2005112506 | | 4/2005 |
| JP | 2006089200 | | 4/2006 |
| JP | 2010069664 | | 4/2010 |
| JP | 2015055774 | | 3/2015 |
| WO | WO-2014012341 | A1 | 1/2014 |

* cited by examiner

MEDIA DIVERSION APPARATUS

BACKGROUND

Printing systems, such as large format printers, may be used to print media of various sizes. An example of media is print-media. The print-media may be paper, photo, film, cardboard, etc. The media may, for example, be in the form of cut-sheets and rolls. The cut-sheet media may refer to individual sheets of media, for example, of size A3 or smaller. The roll media may refer to a continuous roll of media, for example, of a size greater than A3.

BRIEF DESCRIPTION OF DRAWINGS

The following detailed description references the drawings, wherein.

DETAILED DESCRIPTION

Figure 1:
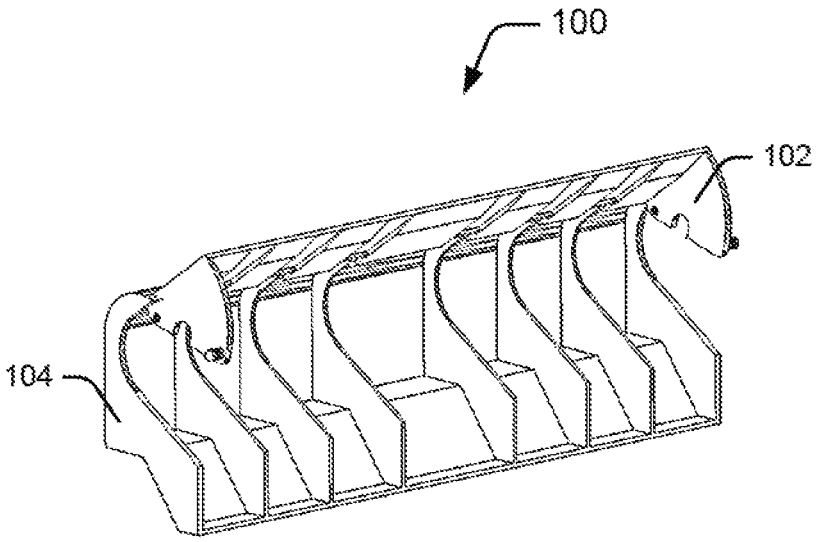
FIG. 1 illustrates a media diversion apparatus, according to an example of the present subject matter.

Printing systems that can print cut-sheet media and roll media may include a print assembly having an automatic media source switching system. The automatic media source switching system may operate to select one of a cut-sheet media source and a roll media source, depending on a print job of the printing system. The media from the selected source is accordingly passed through the print assembly for printing. The media may, for example, include paper, photo, film, cardboard, and such.

With a print assembly being used for selectively passing and printing the cut-sheet media and roll media, a path is followed by media after being printed and dispensed by the print assembly. The roll media, dispensed by the print assembly, curls, rolls, and is generally collected in an output region, such as a basket provided with the printing system. The cut-sheet media, dispended by the print assembly, is collected in an extendable output tray.

With the printing systems, as described above, the output tray in the extended position may interfere with the path of the roll media. Thus, for printing the roll media, a user may have to remove the cut-sheet media, if any, lying on the output tray and retract the output tray to clear the path of the roll media, before a print job for the roll media is executed by the printing system. Similarly, for printing the cut-sheet media, the user may have to pull out the output tray to collect the cut-sheet media and to prevent them from falling into the basket. Such manual extension and retraction of the output tray, or inappropriate position of the output tray during a print job, may, for example, make the collection of the printed media inefficient and affect user experience.

The present subject matter describes a media diversion apparatus that can be coupled to a printing system, for example a large format printer, to automatically route printed cut-sheet media and printed roll media to different output regions. The media diversion apparatus separates the paths of the cut-sheet media and the roll media after being dispensed by a print assembly, which facilitates routing the media to different output regions. The media diversion apparatus of the present subject matter makes collection of the printed media efficient, and eliminates manual interventions that may otherwise be involved in adjusting the output system set-up depending on the type of media printed out by the printing system.

In accordance with an example implementation of the present subject matter, the media diversion apparatus includes a media diverter, in the form of a movable flange-like element. The position of the media diverter is automatically changeable depending on the type of media printed and dispensed by the print assembly of the printing system. The media diverter may be operated mechanically using a lever element, or electrically using an electrical actuator.

In an example implementation, for cut-sheet media, the media diverter is set in a first position to route the cut-sheet media from the print assembly to a first output region. For roll media, the media diverter is set in a second position to route the roll media from the print assembly to a second output region. The first output region may refer to a location from where the cut-sheet media is collected, and the second output region may refer to a location from where the roll media is collected. The first and the second output regions are separated and spaced apart to avoid any interference between the two.

The present subject matter is further described with reference to the accompanying figures. Wherever possible, the same reference numerals are used in the figures and the following description to refer to the same or similar parts. It should be noted that the description and figures merely illustrate principles of the present subject matter. It is thus understood that various arrangements may be devised that, although not explicitly described or shown herein, encompass the principles of the present subject matter. Moreover, all statements herein reciting principles, aspects, and examples of the present subject matter, as well as specific examples thereof, are intended to encompass equivalents thereof.

FIG. 1 illustrates a media diversion apparatus 100, according to an example of the present subject matter. The media diversion apparatus 100, referred to as apparatus 100 hereinafter, can be coupled to a printing system, such as a large format printer. The apparatus 100, as shown, has a media diverter 102 and a guarding element 104. The media diverter 102 is a flange-like element which may be automatically movable between a first position and a second position to route media printed by a print assembly of the printing system. The media diverter 102 in the first position routes cut-sheet media from the print assembly to a first output region of the printing system. The guarding element 104 assists in directing the cut-sheet media to the first output region. The media diverter 102 in the second position routes roll media from the print assembly to a second output region of the printing system.

The media diverter 102 is coupled to the guarding element 104. In an example implementation, the media diverter 102 may be coupled to pivot or rotate about a coupling joint for its movement between the first position and the second position. In an example implementation, the media diverter 102 may be coupled to linearly move up and down between the first position and the second position.

Figure 2:
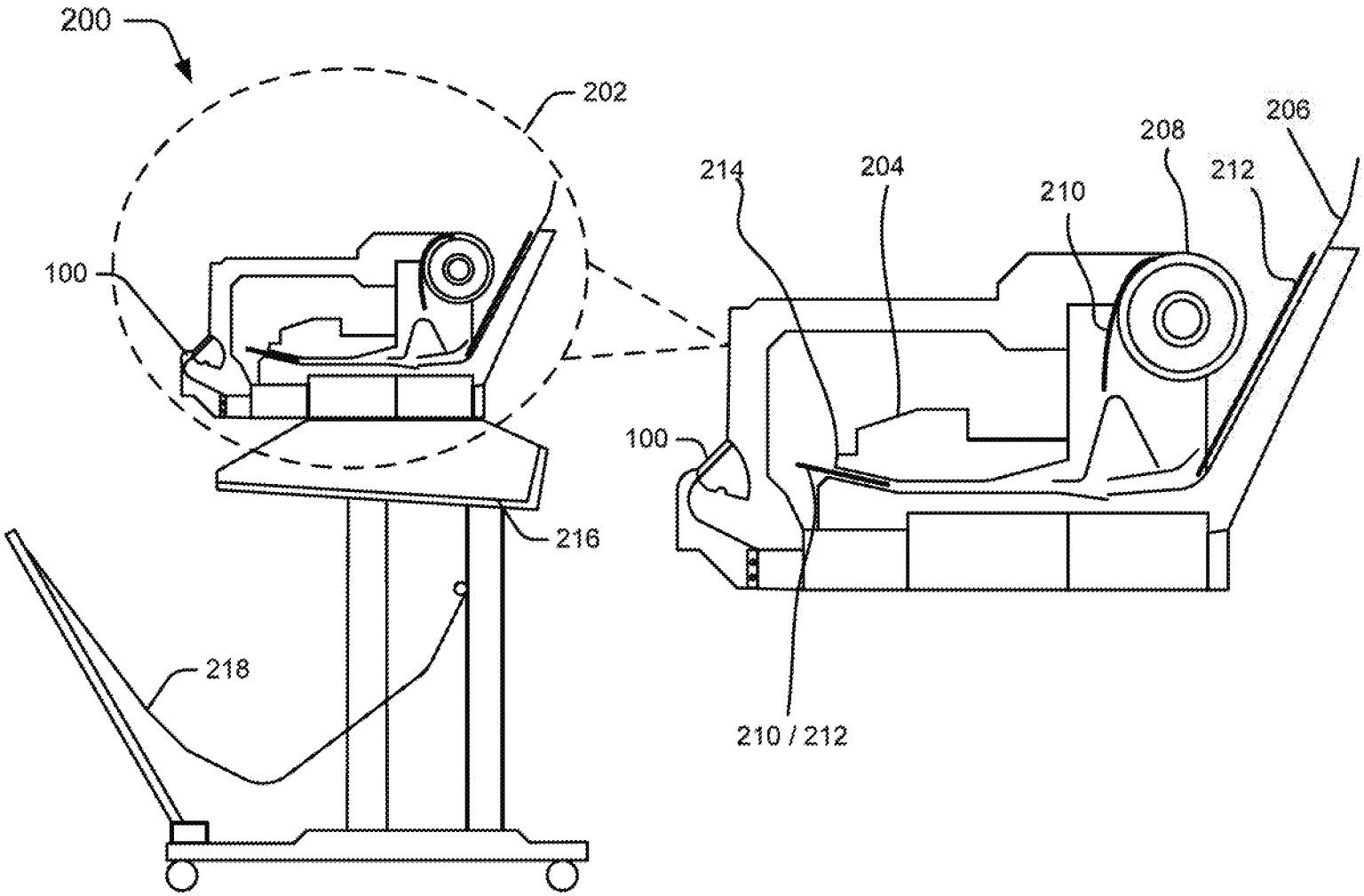
FIG. 2 illustrates the media diversion apparatus of FIG. 1 coupled to a printing system, according to an example of the present subject matter.

FIG. 2 illustrates the apparatus 100 coupled to a printing system 200, according to an example of the present subject matter. The printing system 200, as shown, includes a print assembly 202. The print assembly 202, apart from the other components, has a printing unit 204 with printing fluid reservoirs, a printing fluid pumping system, print heads, and a media feeding assembly. The print assembly 202 also has a cut-sheet media source 206, a roll media source 208, and a media source selector. The media source selector operates to engage or disengage the roll media source 208 depending on a print job being initiated and executed by the printing system 200. For a roll media print job, the media source selector engages the roll media source 208 so that roll media 210 from the roll media source 208 is drawn into the printing unit 204. Similarly, for a cut-sheet media print job, the media source selector disengages the roll media source 208 so that cut-sheet media 212 from the cut-sheet media source 206 is drawn into the printing unit 204. Any media 210, 212, after being printed by the printing unit 204, is advanced and dispensed out by the media feeding assembly of the printing unit 204. The media 210, 212 may be dispensed from a region marked as '214', as shown in FIG. 2.

Further, the printing system 200 includes a first output region 216 where the cut-sheet media 212 is diverted to. The printing system 200 also includes a second output region 218 where the roll media 210 is diverted to. The second output region 218 may be a basket to collect the roll media 210 which is relatively large in size. The first output region 216 may be a chamber positioned under the print assembly 202, as shown, to avoid any interference with the second output region 218. The first output region 216 may be inclined at an angle with respect to the horizontal, which facilitates collection of the cut-sheet media in the first output region 216.

Figure 3A:
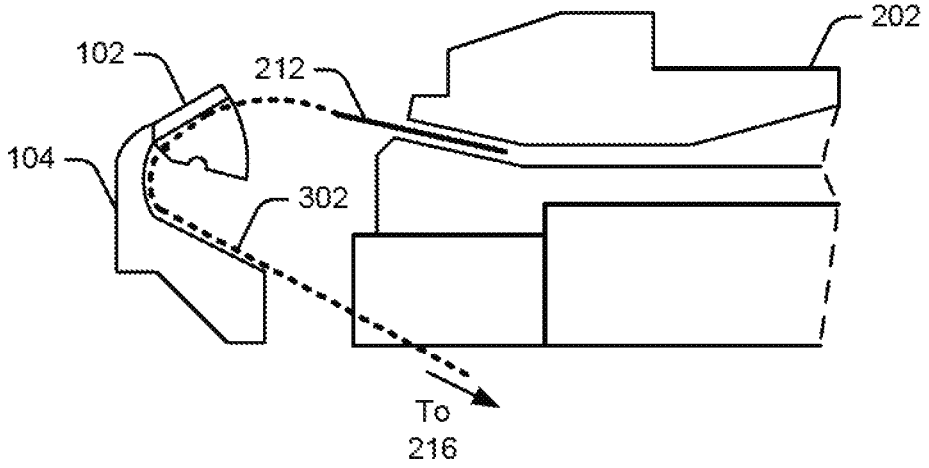
FIGS. 3(*a*)-3(*b*) illustrate different positions of a media diverter of the media diversion apparatus of FIG. 1 for routing cut-sheet media and roll media, according to an example of the present subject matter.
Figure 3B:
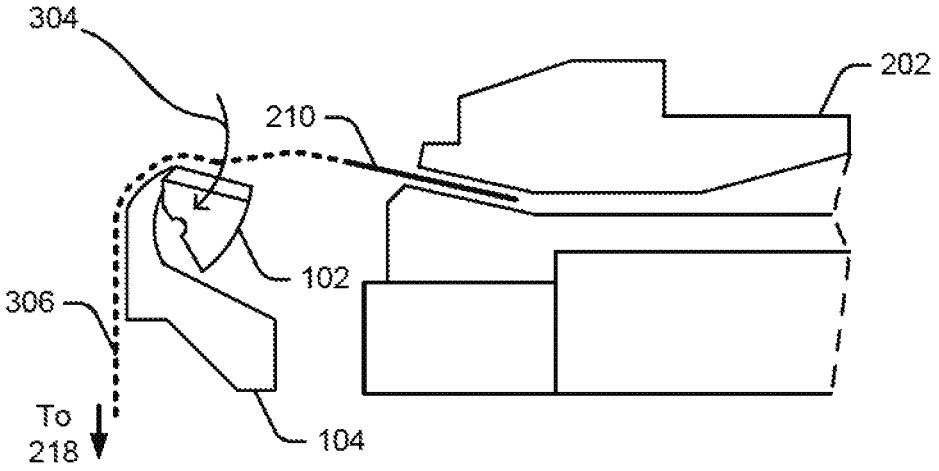

As shown in FIG. 2, the apparatus 100 is coupled to the print assembly 202, such that the apparatus 100 can interact with the media dispensed by the print assembly 202 for the purpose of routing the printed media. FIGS. 3(*a*)-3(*b*) illustrate different positions of the media diverter 102 of the apparatus 100 for routing the cut-sheet media 212 and the roll media 210, according to an example of the present subject matter. The media diverter 102 is automatically positionable in the first position, as shown in FIG. 3(*a*), when the cut-sheet media 212 is printed and dispensed by the print assembly 202. In the first position, the media diverter 102 blocks the cut-sheet media in its path and routes the cut-sheet media from the print assembly 202 to the first output region 216. It may be noted that the media diverter 102 has a length more than the lateral width of the cut-sheet media. The guarding element 104 provides assistance in directing the cut-sheet media to the first output region 216. The path followed by the cut-sheet media is marked as '302' in FIG. 3(*a*).

Further, the media diverter 102 is automatically positionable in the second position, as shown in FIG. 3(*b*), when the roll media 210 is printed and dispensed by the print assembly 202. The media diverter 102 may rotate in a direction marked as '304' in FIG. 3(*b*) to move from the first position to the second position. In the second position, the media diverter 102 allows the roll media 210 to move over the media diverter 102 and the apparatus 100, and follow the path marked as '306' in FIG. 3(*b*) towards the second output region 218. It may be noted that FIG. 3(*b*) shows an example second position of the media diverter 102. In an example implementation, the media diverter 102 may move linearly downwards from the first position, such that in the second position the media diverter 102 allows the roll media 210 to pass over.

The description hereinafter describes various example implementations with respect to the movement of the media diverter 102 between the first position and the second position for routing cut-sheet media and roll media to different output regions.

Figure 4A:
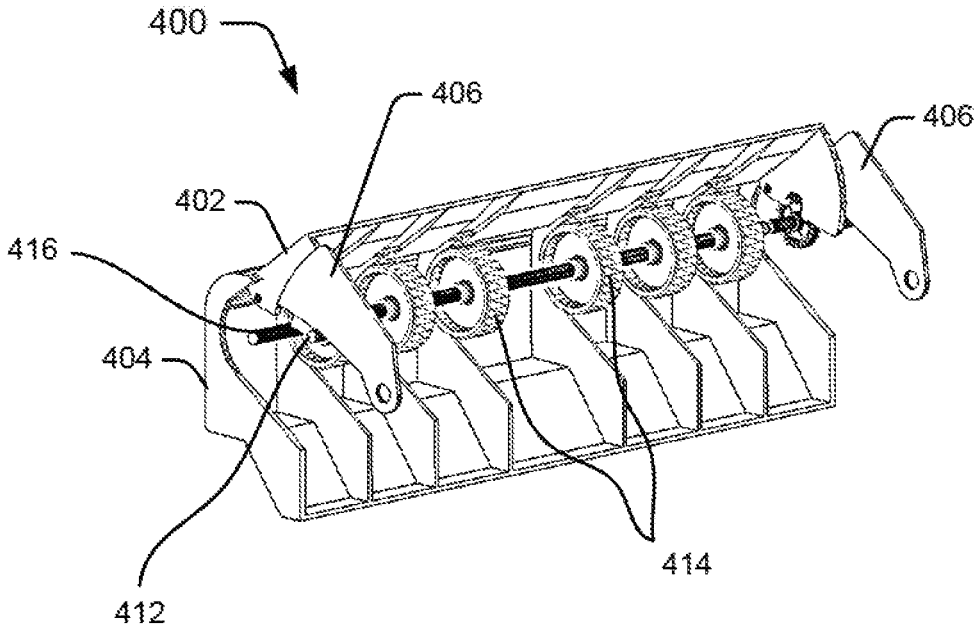
FIGS. 4(*a*)-4(*b*) illustrate perspective views of a media diversion apparatus, according to an example of the present subject matter.
Figure 4B:
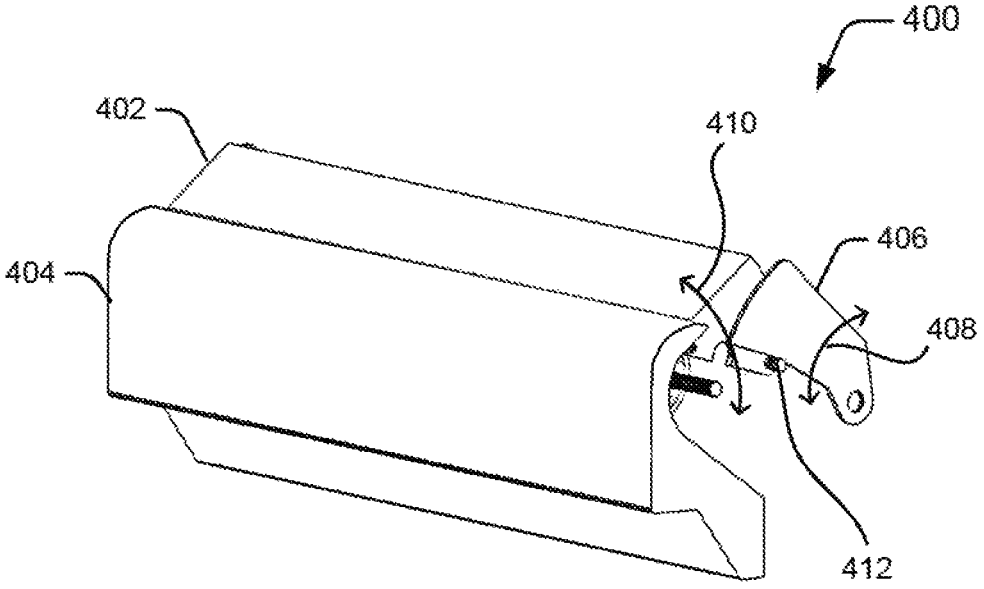

FIGS. 4(*a*)-4(*b*) illustrate perspective views of a media diversion apparatus 400, according to an example of the present subject matter. The apparatus 400 includes a media diverter 402 and a guarding element 404 similar to those of the apparatus 100 shown in FIG. 1. The apparatus 400 also includes a lever element 406. The lever element 406 is coupled to the media diverter 402, such that any movement of the lever element 406 is translated to, or experienced by, the media diverter 402.

In an example implementation, the lever element 406 is movable in a direction marked as '408' in FIG. 4(*b*) and the media diverter 402 is movable in a direction marked as '410' in FIG. 4(*b*). Further, in an example implementation, the media diverter 402 may have notches 412 (visible on one side of the media diverter 402 in FIGS. 4(*a*) and 4(*b*)) on which the lever element 406 may rest. Thus, any movement of the lever element 406 in the anti-clockwise direction causes a movement of the media diverter 402 in the clockwise direction.

In an example implementation, the lever element 406 and the media diverter 402 are spring loaded to retract or set the media diverter 402 in a first position to route the cut-sheet media. Further, the lever element 406 is movable under the weight of roll media to set the media diverter 402 to the second position to route the roll media.

In an example implementation, the apparatus 400 includes a driver roller assembly that operates to bend and advance cut-sheet media, routed by the media diverter 402, into a first output region of a printing system. The driver roller assembly includes a plurality of driver rollers 414 coupled through a shaft 416. A motor (not shown) may be coupled to the shaft 416 of the driver roller assembly through a gear assembly (not shown) to rotate the shaft 416 and the driver rollers 414.

In an example implementation, the apparatus 400 also includes a star wheel assembly (not shown) corresponding to the driver roller assembly. The star wheel assembly may include a plurality of star wheels at positions corresponding to the positions of the driver roller 414, such that the star wheels can grip the cut-sheet media being rolled over the driver roller assembly. The driver roller assembly and the star wheel assembly facilitate advancing the cut-sheet media into a first output region of a printing system.

Figure 5A:
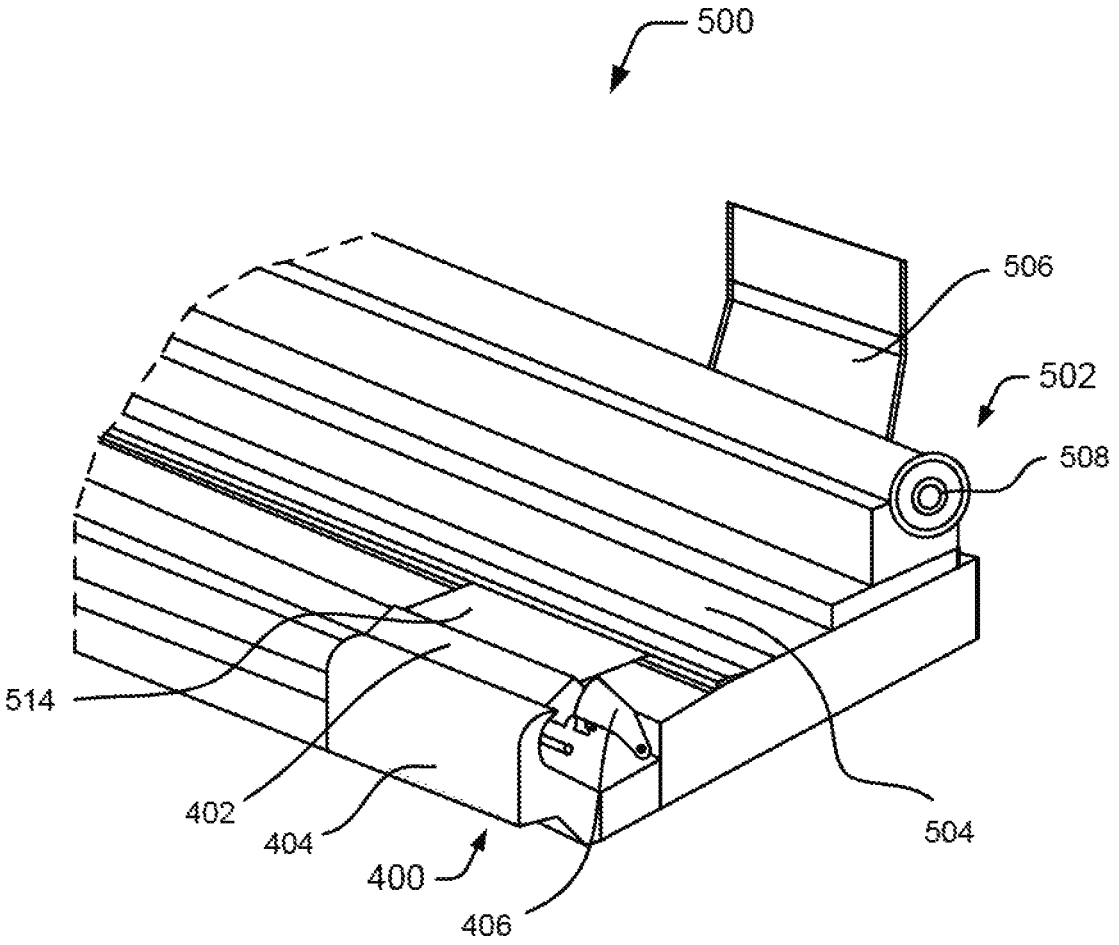
FIGS. 5(*a*)-5(*b*) illustrate a printing system with the media diversion apparatus of FIG. 4 in a first position to route cut-sheet media, according to an example of the present subject matter.
Figure 5B:
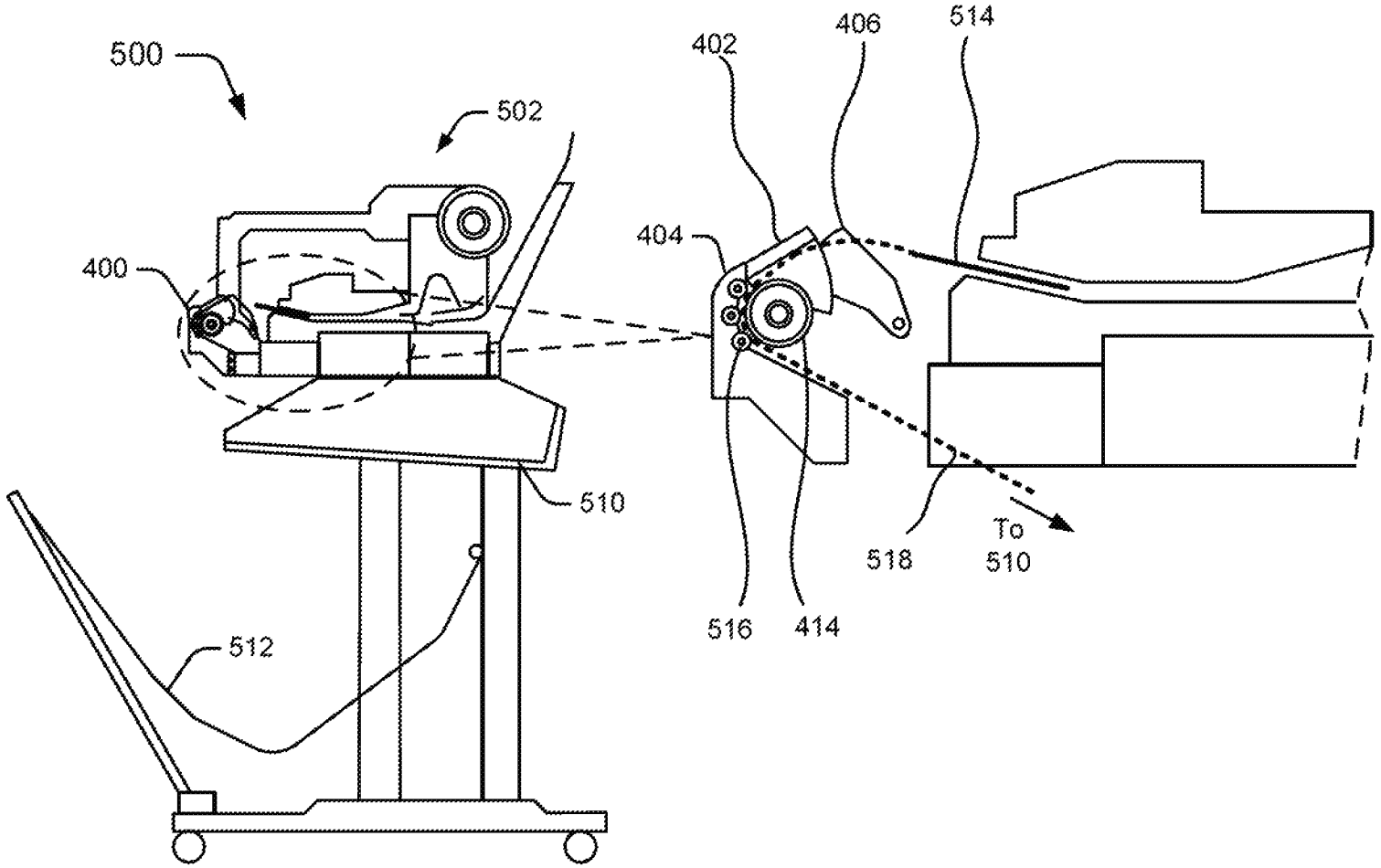

FIGS. 5(*a*)-5(*b*) illustrate a printing system 500 with the media diversion apparatus 400 in a first position to route the cut-sheet media, according to an example of the present subject matter. The printing system 500 includes components similar to those of the printing system 200 as described earlier. For example, the printing system 500 includes a print assembly 502 having a printing unit 504, a cut-sheet media source 506, a roll media source 508, and a media source selector (not shown). The printing system 500 also includes a first output region 510 to collect cut-sheet media, and includes a second output region 512 to collect roll media.

The media diverter 402 and the lever element 406 of the apparatus 400, respectively, may be spring loaded to set the media diverter 402 in the first position when the cut-sheet media 514 is dispensed from the print assembly 502. The first position of the media diverter 402 may also be its default position, or a position when the printing system 500 is not in operation. Since the lateral width of the cut-sheet media 514 is less than the length of the media diverter 402, the media diverter 402 in the first position blocks the cut-sheet media 514. The cut-sheet media 514 therefore flows inside the media diverter 402 and passes over the driver rollers 414 of the apparatus 400 to bend and advance into the first output region 510. The star wheels 516 of the apparatus 400 grip the cut-sheet media 514, which helps in advancing the cut-sheet media 514 into the first output region 510. The path followed by the cut-sheet media 514 inside the apparatus 400 and towards the first output region 510 is marked as '518' in FIG. 5(*b*).

Figure 6A:
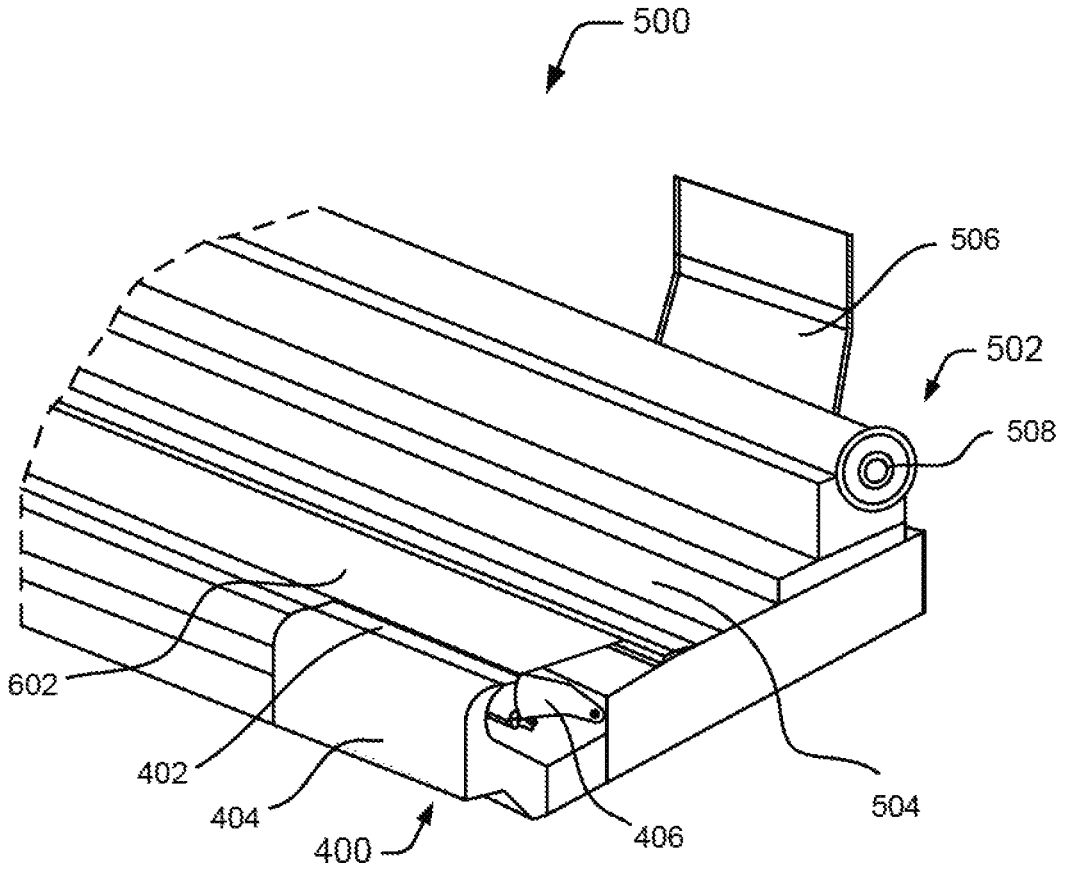
FIGS. 6(*a*)-6(*b*) illustrate a printing system with the media diversion apparatus of FIG. 4 in a second position to route roll media, according to an example of the present subject matter.
Figure 6B:
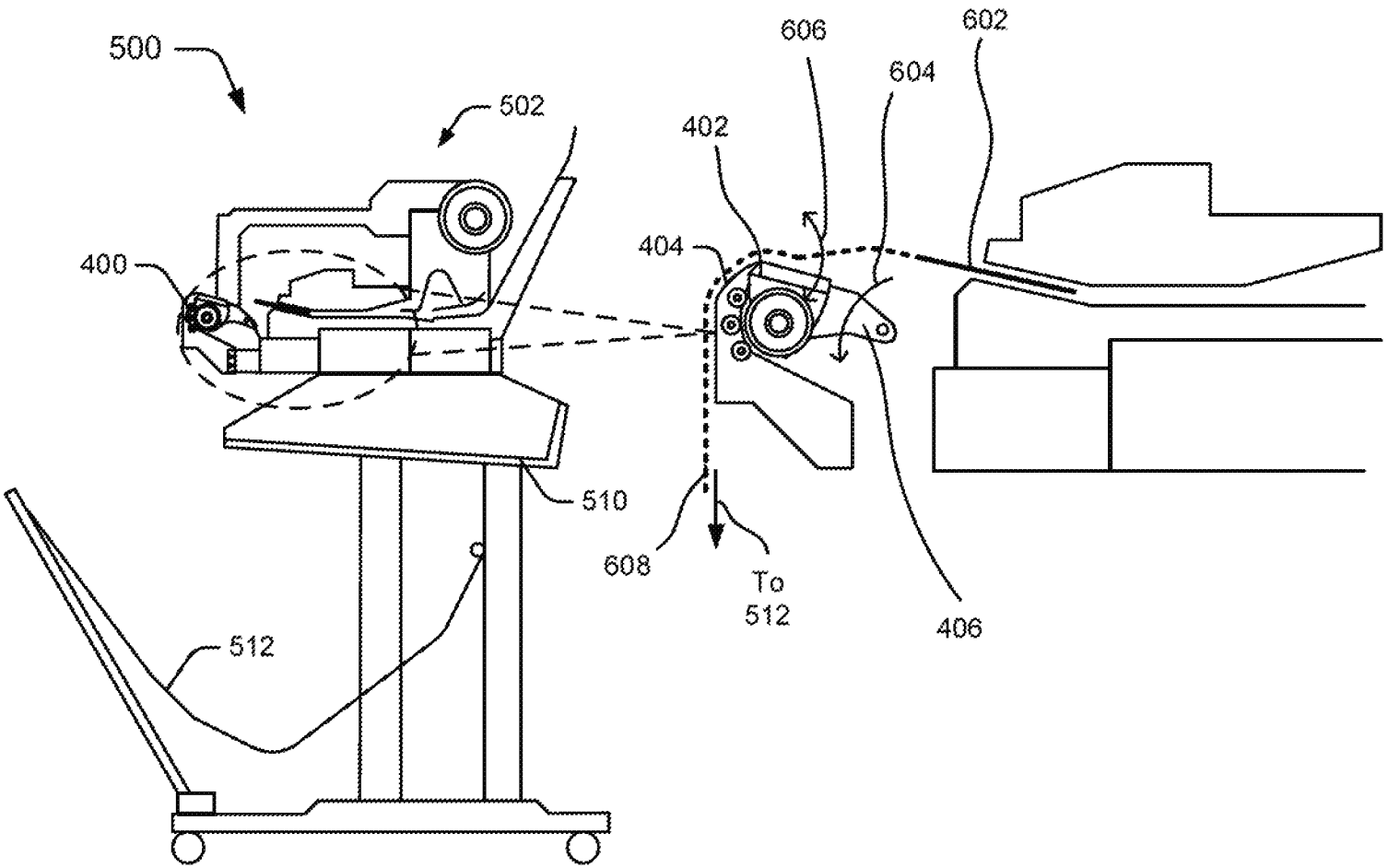

FIGS. 6(*a*)-6(*b*) illustrate the printing system 500 with the media diversion apparatus 400 in a second position to route roll media 602, according to an example of the present subject matter. Because of a larger lateral width, the roll media 602 comes in contact with the lever element 406 of the apparatus 400. The lever element 406, under the weight of the roll media 602, moves in a direction marked as '604' in FIG. 6(*b*), which in turn moves the media diverter 402 in a direction marked as '606' in FIG. 6(*b*). Such movements under the weight of the roll media 602 set the media diverter 402 in the second position, which allows the roll media 602 to pass over the apparatus 400 and into the second output region 512. The path followed by the roll media 602 towards the second output region 512 is marked as '608' in FIG. 6(*b*).

As mentioned earlier, the media diverter 402 and the lever element 406 of the apparatus 400 may be spring loaded. It may be noted that springs coupled to the media diverter 402 and the lever element 406 may be such that the weight of the roll media 602 can overcome the spring force of the springs to move the lever element 406 and in turn move the media diverter 402 from the first position to the second position.

It may be noted that the apparatus 400, as shown and described, has the media diverter 402 and the lever element 406 which rotate between the first position and the second position. In an example implementation, the media diverter and the lever element of the apparatus may move linearly to separate the paths of the cut-sheet media and the roll media for routing the cut-sheet media to the first output region and routing the roll media to the second output region.

In an example implementation, the lever element 406 of the apparatus 400 may be coupled to an actuator (not shown). The lever element 406 may be actuated by the actuator to set the media diverter 402 in the first position when the cut-sheet media is printed by a print assembly. The lever element 406 may also be actuated by the actuator to set the media diverter 402 in the second position when the roll media is printed by the print assembly. The actuator may be coupled to a processor. The processor may be of the apparatus 400 or of a print assembly of a printing system to which the apparatus 400 is coupled. The processor may determine whether a print job to be executed is for cut-sheet media or for roll media. If the print job is for the cut-sheet media, the processor may operate the actuator to actuate the lever element 406 in a direction to set the media diverter 402 in the first position. If the print job is for the roll media, the processor may operate the actuator to actuate the lever element 406 in another direction to set the media diverter 402 in the second position. In an example implementation, the actuator may be a linear actuator or a motor, depending on the assembly of the apparatus 400.

Further, in an example implementation, the media diverter of the apparatus may be coupled to an actuator (not shown). The media diverter may be actuated by the actuator to set the media diverter in the first position when the cut-sheet media is printed by a print assembly. The media diverter may also be actuated by the actuator to set the media diverter in the second position when the roll media is printed by the print assembly. The actuator may be coupled to a processor of the apparatus or of a print assembly of a printing system to which the apparatus is coupled. The processor may determine whether a print job to be executed is for cut-sheet media or for roll media. If the print job is for the cut-sheet media, the processor may operate the actuator to actuate and set the media diverter in the first position. If the print job is for the roll media, the processor may operate the actuator to actuate and set the media diverter in the second position. In an example implementation, the actuator may be a linear actuator or a motor, depending on the assembly of the apparatus.

The processor may be implemented as microprocessors, microcomputers, microcontrollers, digital signal processors, central processing units, state machines, logic circuitries, and/or any devices that manipulate signals based on operational instructions. Among other capabilities, the processor may fetch and execute computer-readable instructions stored in a non-transitory computer-readable storage medium coupled to the processor. The non-transitory computer-readable storage medium may include, for example, volatile memory (e.g., RAM), and/or non-volatile memory (e.g., EPROM, flash memory, NVRAM, memristor, etc.).

Although examples for the present disclosure have been described in language specific to structural features, it is to be understood that the appended claims are not limited to the specific features described herein. Rather, the specific features are disclosed and explained as examples of the present disclosure.

We claim:

1. A media diversion apparatus for a printing system, the apparatus comprising a media diverter to route media printed by a print assembly of the printing system, wherein the media diverter, in a first position, is to route cut-sheet media from the print assembly to a first output region; and the media diverter, in a second position, is to route roll media from the print assembly to a second output region;

the media diversion apparatus further comprising a lever element positioned to contact the roll media and not contact the cut-sheet media, the lever element movable under the weight of the roll media dispensed by the print assembly to set the media diverter to the second position.

2. The media diversion apparatus as claimed in claim 1, wherein the media diverter is coupled to the lever element, wherein the lever element is spring loaded to set the media diverter in the first position when the cut-sheet media is dispensed from the print assembly.

3. The media diversion apparatus as claimed in claim 1, further comprising a driver roller assembly to bend and roll the cut-sheet media, routed by the media diverter, into the first output region.

4. The media diversion apparatus as claimed in claim 3, further comprising a star wheel assembly, corresponding to the driver roller assembly, to grip the cut-sheet media being rolled over the driver roller assembly.

5. A system for printing roll media and cut-sheet media, the system comprising:

a print assembly; and a media diversion apparatus coupled to the print assembly, the apparatus comprising a media diverter and a lever element to route the roll media and the cut-sheet media printed by the print assembly, wherein the media diverter is positionable in a first position to route the cut-sheet media from the print assembly to a first output region of the system, when the cut-sheet media is printed by the print assembly;

the media diverter is positionable in a second position to route the roll media from the print assembly to a second output region of the system, when the roll media is printed by the print assembly; and the lever element is positioned to contact the roll media and not contact the cut-sheet media, the lever element movable under the weight of the roll media to set the media diverter to the second position.

6. The system as claimed in claim 5, wherein the lever element is spring loaded to set the media diverter in the first position when the cut-sheet media is dispensed from the print assembly.

7. A large format printer comprising:

a print assembly; and a media diversion apparatus coupled to the print assembly, the apparatus comprising:

a media diverter to route roll media and cut-sheet media printed by the print assembly; and a lever element coupled to the media diverter, wherein the lever element is movable to:

set the media diverter in a first position to route the cut-sheet media from the print assembly to a first output region; and set the media diverter in a second position to route the roll media from the print assembly to a second output region;

wherein the lever element is positioned to contact the roll media and not contact the cut-sheet media, and wherein the lever element is rotatable under the weight of the roll media dispensed by the print assembly to set the media diverter to the second position.

8. The large format printer as claimed in claim 7, wherein the lever element is spring loaded to retract the media diverter in the first position to route the cut-sheet media to the first output region, when the cut-sheet media is dispensed by the print assembly.

9. The system as claimed in claim 5, further comprising:

a basket to define the second output region, the basket shaped to collect the roll media as the roll media curls or rolls.

10. The large format printer as claimed in claim 7, further comprising:

a basket to define the second output region, the basket shaped to collect the roll media as the roll media curls or rolls.

* * * * *